US008668025B2

(12) United States Patent
Kinnen et al.

(10) Patent No.: US 8,668,025 B2
(45) Date of Patent: Mar. 11, 2014

(54) HAND-GUIDED WORK APPARATUS

(75) Inventors: Arno Kinnen, Fellbach (DE); Felix Mayer, Waiblingen (DE); Wolfgang Layher, Besigheim (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 214 days.

(21) Appl. No.: 13/087,025

(22) Filed: Apr. 14, 2011

(65) Prior Publication Data

US 2011/0253401 A1 Oct. 20, 2011

(30) Foreign Application Priority Data

Apr. 15, 2010 (DE) ..... 10 2010 015 087

(51) Int. Cl.
*B25B 27/22* (2006.01)

(52) U.S. Cl.
USPC ..... 173/20; 173/2; 30/381

(58) Field of Classification Search
USPC ..... 173/1, 2, 20, 46; 30/381, 382, 383; 123/2; 73/116.02; 374/144, 143, 208
See application file for complete search history.

(56) References Cited

U.S. PATENT DOCUMENTS

| | | | | | |
|---|---|---|---|---|---|
| 4,483,072 | A * | 11/1984 | Nagashima et al. | ..... | 30/381 |
| 4,543,723 | A * | 10/1985 | Bortfeld et al. | ..... | 30/381 |
| 4,753,012 | A * | 6/1988 | Schurr | ..... | 30/382 |
| 5,404,843 | A * | 4/1995 | Kato | ..... | 123/73 B |
| 6,272,913 | B1 | 8/2001 | Naegele et al. | | |
| 7,690,262 | B2 * | 4/2010 | Nakabayashi | ..... | 73/708 |
| 7,814,888 | B2 | 10/2010 | Rosskamp et al. | | |
| 2008/0041146 | A1 * | 2/2008 | Leufen | ..... | 73/116 |
| 2008/0250862 | A1 * | 10/2008 | Nakabayashi | ..... | 73/756 |

* cited by examiner

*Primary Examiner* — Thanh K Truong
*Assistant Examiner* — Nathaniel Chukwurah
(74) *Attorney, Agent, or Firm* — Walter Ottesen P.A.

(57) ABSTRACT

A hand-guided work apparatus includes a combustion engine to drive a work tool. The combustion engine includes a crankcase (14) in which a crankshaft (16) is rotatably mounted about a rotational axis (44). A pressure sensor (27) and a temperature sensor (26) are arranged on the crankcase (14). The pressure sensor (27) and the temperature sensor (26) are arranged in a common sensor housing (31). In the typical put-down position (8) of the work apparatus, the pressure sensor (27) and the temperature sensor (26) are arranged below a plane (45) which is parallel to the horizontal storage surface (7) and contains the rotational axis (44) of the crankshaft (16). A connecting channel (25) is formed in the sensor housing (31). The connecting channel (25) connects the pressure sensor (27) to the crankcase interior (20) and the base (35) of the connecting channel (25) slopes down toward the crankcase interior (20) in the typical put-down position (8) of the work apparatus.

12 Claims, 3 Drawing Sheets

HAND-GUIDED WORK APPARATUS

CROSS REFERENCE TO RELATED APPLICATION

This application claims priority of German patent application no. 10 2010 015 087.8, filed Apr. 15, 2010, the entire content of which is incorporated herein by reference.

BACKGROUND OF THE INVENTION

U.S. Pat. No. 7,814,888 B2 discloses a combustion engine which can serve to drive a work tool of a hand-guided work apparatus. A temperature sensor and a pressure sensor are arranged on the crankcase of the combustion engine.

U.S. Pat. No. 6,272,913 B1, for example, discloses arranging a pressure sensor and a temperature sensor in a common housing. Such sensors are typically used to measure the pressure and the temperature in the intake channel of a combustion engine.

SUMMARY OF THE INVENTION

It is an object of the invention to provide a hand-guided work apparatus which has a small size and enables safe operation.

The hand-guided work apparatus of the invention includes: a combustion engine having a crankcase defining a crankcase interior; a crankshaft rotatably mounted about a rotational axis in the crankcase; a pressure sensor and a temperature sensor; a sensor housing common to both of the sensors; the temperature sensor and the pressure sensor being arranged in the sensor housing; the work apparatus being configured to have a set-down position wherein the work apparatus is placeable on a horizontal rest surface; the pressure sensor and the temperature sensor being beneath a plane containing the rotational axis and the plane being parallel to the rest surface when the work apparatus is in the set-down position; the sensor housing defining a connecting channel for causing the pressure sensor to communicate with the crankcase interior; and, the connecting channel having a base which slopes down toward the crankcase interior when the work apparatus is in the set-down position on the rest surface.

The arrangement of pressure sensor and temperature sensor in a common sensor housing and the arrangement, for example, below the rotational axis of the crankshaft enables a space-saving arrangement. In the area lying below the rotational axis of the crankshaft, there typically is sufficient space for the arrangement of the temperature sensor and the pressure sensor. It has, however, been shown that when the pressure sensor and temperature sensor are arranged below the level of the crankshaft axis, the pressure sensor can accumulate contaminants, oil and the like, so that a safe operation cannot be ensured. This is avoided by the alignment of the base of the connecting channel of the pressure sensor relative to the crankcase interior. Oil and the like can still accumulate in the area of the pressure sensor during operation. When putting down the work tool, at which point the engine is typically still warm, it is ensured, however, that these contaminants can flow off the pressure sensor, so that any drying onto the pressure sensor is avoided. Thus, a durable operation of the pressure sensor is ensured.

Advantageously, the connecting channel widens at least partially funnel-shaped in the direction of the crankcase interior. It has been shown that a cylindrical channel configuration of the connecting channel can lead to a standing pressure wave which falsifies the measurement result. The funnel-shaped configuration also aids the gas exchange in the area of the pressure sensor and the temperature sensor, so that it is ensured that the temperature sensor measures the actual gas temperature in the crankcase. Advantageously, the temperature sensor is arranged in the connecting channel and does not project into the crankcase interior. The temperature sensor is in particular configured in an approximately rod-shaped manner and projects unobstructed into the connecting channel, so that the temperature sensor is surrounded by gas in the crankcase from all sides. Thus, good measurement results are achieved.

To protect the pressure sensor from mechanical damage during assembly or during servicing, the pressure sensor is arranged at the end of the connecting channel and the temperature sensor is arranged in front of the pressure sensor. The temperature sensor thus provides simple mechanical protection for the pressure sensor's membrane delimiting the connecting channel. Advantageously, the connecting channel has a first cylindrical section and a second funnel-shaped section. The first section connects to the pressure sensor and the temperature sensor is arranged in the first section. Thus, a simple configuration is achieved.

Advantageously, the sensor housing has a connecting stub through which the connecting channel extends and which is inserted into a receptacle on the crankcase. The longitudinal center axis of the connecting stub advantageously slopes upward in the direction of the crankcase interior when the work tool is put down. Thus, a space-saving arrangement results. The connecting channel can be configured comparatively short as a result of this alignment of the connecting stub and this counteracts dirt accumulating in the connecting channel.

Advantageously, the sensor housing is sealed off against the crankcase in the radial direction of the connecting stub. The contact pressure force of the seal does not need to be applied to the crankcase by the fastening elements of the sensor housing. Thus, the fastening is easier to configure, and a secure seal can be achieved independently of the holding force applied by the fastening elements. A simple configuration results when the connecting stub has a sealing ring on its outer periphery, which ring seals the sensor housing off against the crankcase. The sealing ring is advantageously configured such that the sensor housing is already held by the sealing ring in the receptacle of the crankcase. The connecting stub, in particular, has a front edge facing the crankcase interior, whose course is adapted to the roundings of the crankcase interior. Thus, a consistent course of the wall of the crankcase interior is achieved. The front edge of the connecting stub also forms, in particular, a section of the wall of the crankcase interior. In order to ensure that the sensor housing does not become removed from the receptacle during operation, for example, as a result of vibrations, the sensor housing is held on the crankcase in the axial direction with a fastening element. Because of the radial sealing, the fastening element does not need to apply the contact pressure force for the seal but must only fix the sensor housing on the crankcase. Thus, fewer fastening elements can be used than in the case of axial sealing. Thus, the space required can be reduced.

Advantageously, the pressure sensor and the temperature sensor are arranged on a common board which is held in the sensor housing. The sensors are, in particular, potted in the sensor housing with the board. Thus, protection of the sensors and the board from outside influences and a secure fixation in the housing are achieved in a simple manner.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
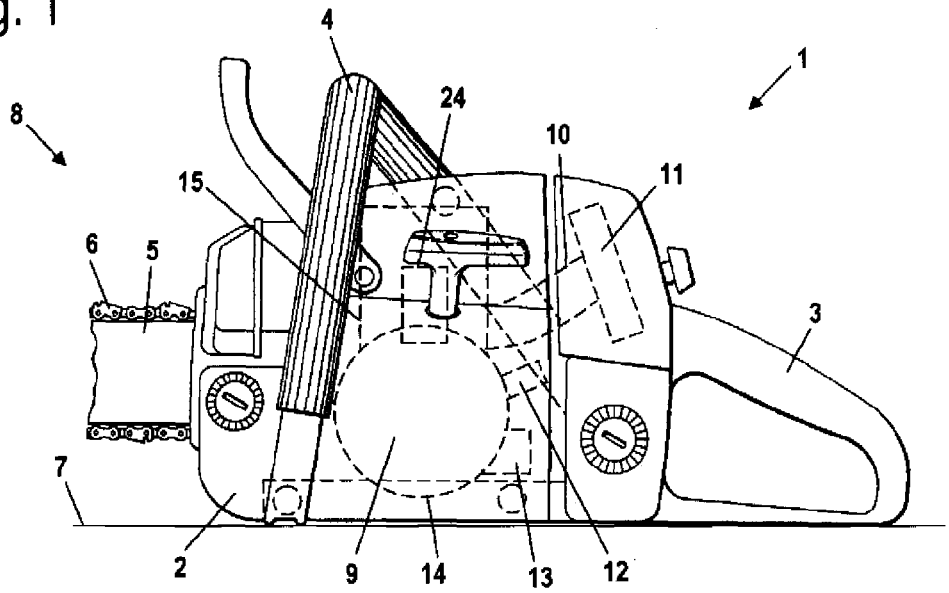
FIG. 1 is a schematic side elevation view of a chain saw.

FIG. 1 schematically shows a chain saw 1 as an example for a hand-guided work apparatus. The provided configuration can also be advantageous in other hand-guided, especially in hand-held work apparatus such as cut-off machines, brush-cutters or the like.

The chain saw 1 has a housing 2 on which a rear handle 3 and a handle bar 4 to guide the chain saw 1 during operation are arranged. On the end of the housing 2 opposite the rear handle 4, there is a guide bar 5 which projects forwardly. A saw chain 6 is arranged on the periphery of the guide bar 5. The saw chain 6 is driven by a two-stroke engine 9. In FIG. 1, the chain saw 1 is shown in the typical put-down position 8 in which the chain saw 1 is arranged on a horizontal storage surface 7. In this embodiment, the chain saw 1 rests on the storage surface 7 with the bottom side of the handle bar 4 and the bottom side of the rear handle 3. The position which results from putting down on the horizontal storage surface 7 is referred to as the typical put-down position 8. Other work apparatuses, for example, cut-off machines, can rest or stand on the floor with other elements, for example, feet or housing parts provided for this purpose.

The two-stroke engine 9 draws in surrounding air through an intake channel 10 and into a crankcase 14 via an air filter 11. The crankcase 14 is connected to a combustion chamber formed in a cylinder 15 of the two-stroke engine 9 via at least one transfer channel 24. On the crankcase 14, there is arranged a fuel valve 12 which supplies fuel to the combustion air drawn into the crankcase interior. The fuel is prepared as an air/fuel mixture and passes over into the combustion chamber via at least one transfer channel 24. A sensor component 13 is arranged on the crankcase 14 and is described in more detail below.

Figure 2:
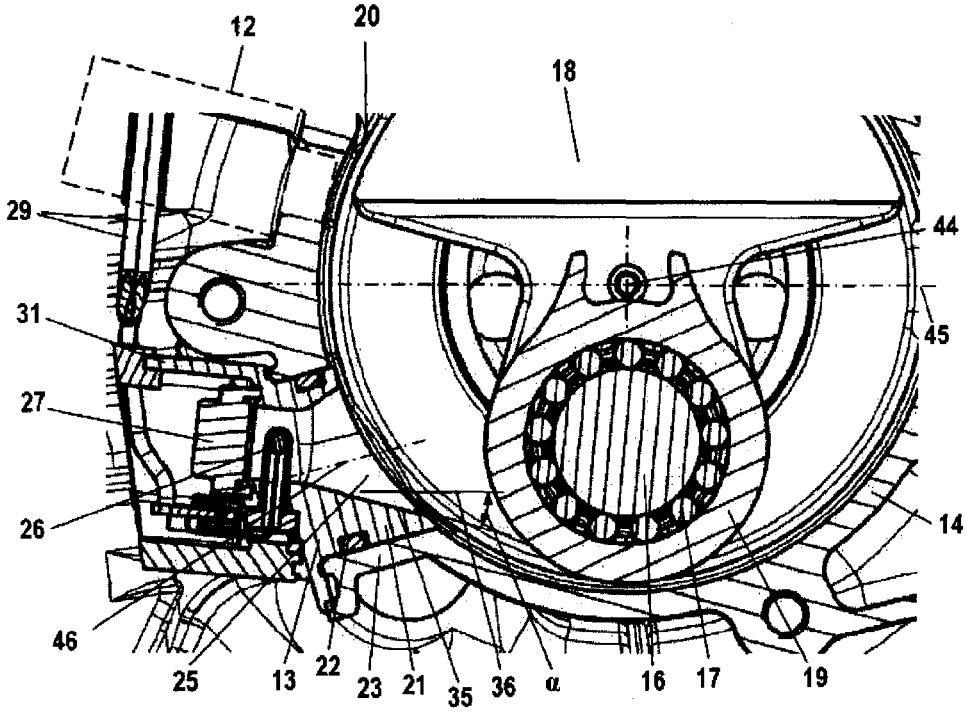
FIG. 2 is a partial section view of the crankcase of the chain saw of FIG. 1.

As FIG. 2 shows, a crankshaft 16 is rotatably mounted about a rotational axis 44 in the interior 20 of the crankcase. The crankshaft 16 is rotatingly driven by a piston, not shown, which moves reciprocatingly in the cylinder 15. Crank webs 18, which serve as counterweights to the piston, are arranged on the crankshaft 16. A connecting rod 19 is also journalled on the crankshaft 16 with a connecting rod bearing 17. The connecting rod 19 transfers the motion of the piston to the crankshaft 16. The outer periphery of the crank webs 18 is designed partially circular-shaped about the rotational axis 44. The wall defining the crankcase interior 20 is in close proximity to the outer periphery of the crank webs 18 and is also configured to have a circular shape.

As FIG. 2 shows, the fuel valve 12 is arranged on the crankcase 14 above a plane 45. The plane 45 is parallel to the storage surface 7 in the put-down position 8 and includes the rotational axis 44 of the crankshaft 16. The sensor component 13 is arranged below the plane 45. The sensor component 13 includes a sensor housing 31 in which a temperature sensor 26 and a pressure sensor 27 are arranged. The sensor housing 31 has a connecting stub 21 whose outer periphery is configured cylindrically and which is inserted into a receptacle 23 of the crankcase 14. A sealing ring 22 seals the sensor housing 31 off against the crankcase 14 in the radial direction to a longitudinal center axis 46 of the connecting stub 21. The sealing ring 22 is provided on the outer periphery of the connecting stub 21. A connecting channel 25 connects the crankcase interior 20 to the pressure sensor 27 and the temperature sensor 26 and projects through the connecting stub 21. In the embodiment, the connecting channel 25 is longer than the connecting stub 21 and fully extends through the connecting stub 21. It can also be provided, however, that the connecting channel 25 is shorter than the connecting stub 21 and does not fully project through the connecting stub 21.

As FIG. 2 shows, the longitudinal center axis 46 is arranged sloping upwards toward the crankcase interior 20. The base 35 of the connecting channel 25, however, slopes down toward the crankcase interior. The base 35 slopes down at an angle $\alpha$ relative to an imaginary line 36 which, in the put-down position 8, is parallel to the storage surface 7. The angle $\alpha$ can, in particular, be approximately 5° to approximately 30°. Advantageously, the angle $\alpha$ is approximately 10° to approximately 20°.

Figure 3:
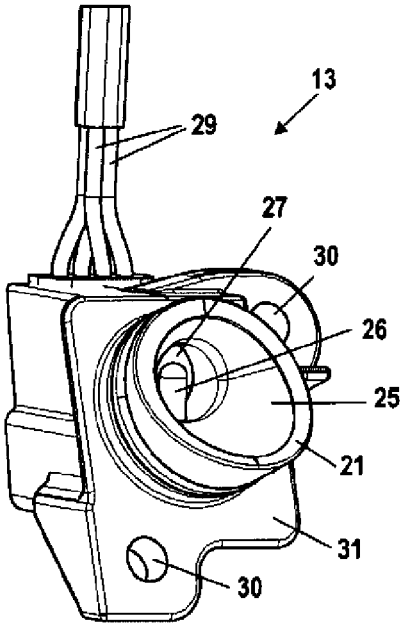
FIG. 3 is a perspective view of the sensor component of the work apparatus.
Figure 4:
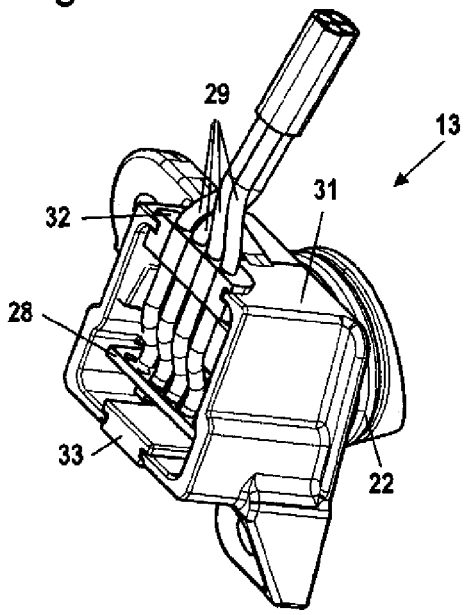
FIG. 4 is a perspective view of the sensor component of the work apparatus.
Figure 5:
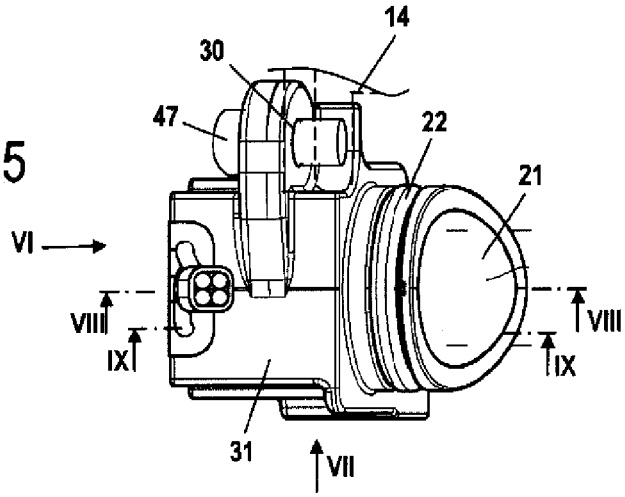
FIG. 5 is a view from above onto the sensor component.
Figure 6:
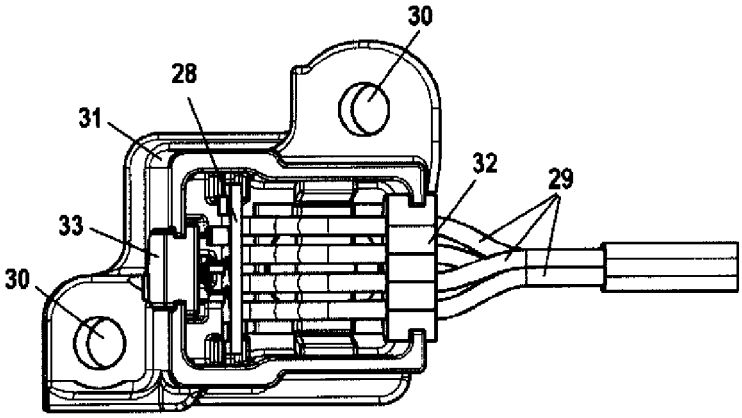
FIG. 6 is a side view in the direction of the arrow VI of FIG. 5.

FIGS. 3 to 10 show the configuration of the sensor component 13 in detail. As FIG. 3 shows, the temperature sensor 26 is arranged ahead of the pressure sensor 27. Thus, the pressure sensor 27 is mechanically protected from unintentional damage, for example, during assembly and during servicing. The pressure sensor 27 is arranged at the end of the connecting channel 25. Two mounting apertures 30, on which the sensor component 13 can be secured to the crankcase, are provided adjacent to the connecting stubs 21 on the sensor housing 31 for mounting the sensor component 13 on the crankcase 14. This is schematically shown in FIG. 5. For example, a screw 47 can be provided as the fastening element. Because of the radial sealing, no contact pressure forces have to be applied by the fastening element for the sealing. The fastening elements only serve to secure against falling out of the receptacle 23.

A board 28, on which the sensors 26 and 27 are held, is arranged in the sensor housing 31. The board 28 is contacted via four connecting lines 29 which are guided outwardly via a holder 32. Connecting lines 29 are held in the holder 32. The holder 32 is held in the housing wall of the housing 31 by a groove. An insert module 33, which will be described in more detail below, is provided on the opposite side of the holder 32.

Figure 7:
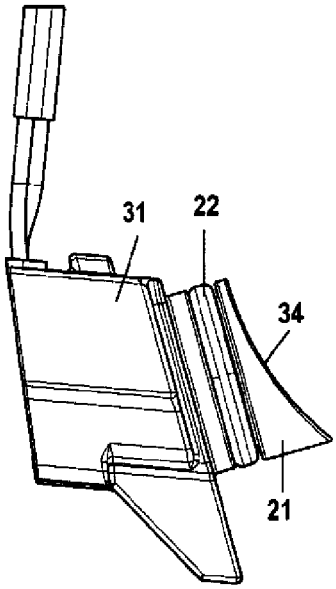
FIG. 7 is a side view in the direction of the arrow VII of FIG. 5.

FIG. 7 shows the front edge 34 of the connecting stub 21 which faces the crankcase interior 20 and is configured in a curved manner. The rounding of the front edge 34 is adapted to the rounding of the housing wall of the crankcase 14.

Figure 8:
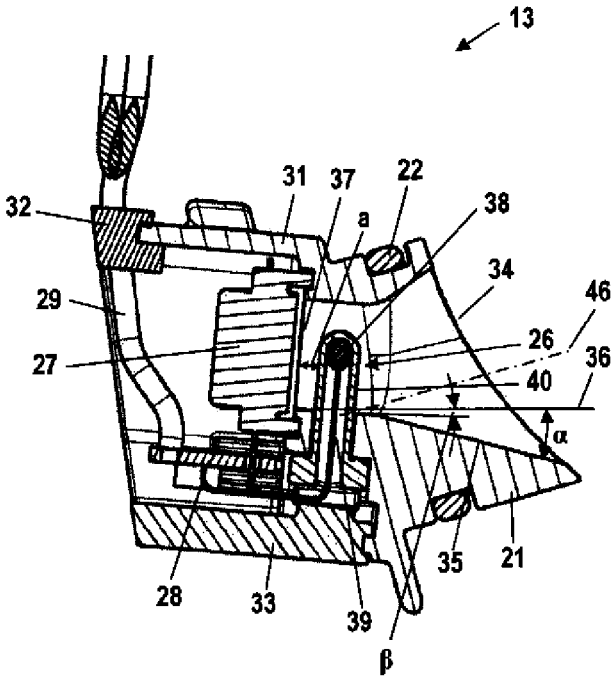
FIG. 8 is a section view along the line VIII-VIII of FIG. 5.
Figure 9:
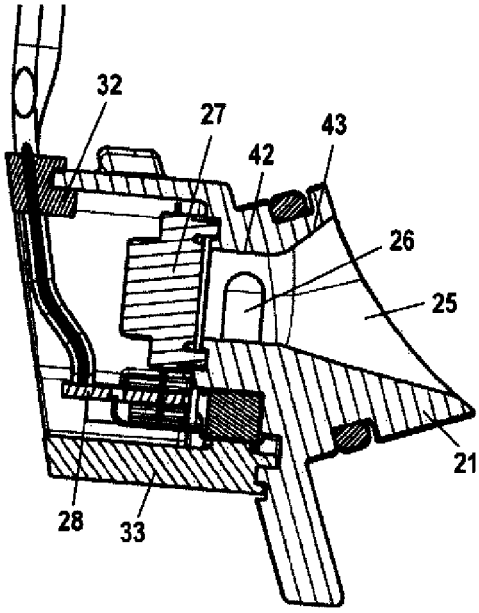
FIG. 9 is a section view along the line IX-IX of FIG. 5.
Figure 10:
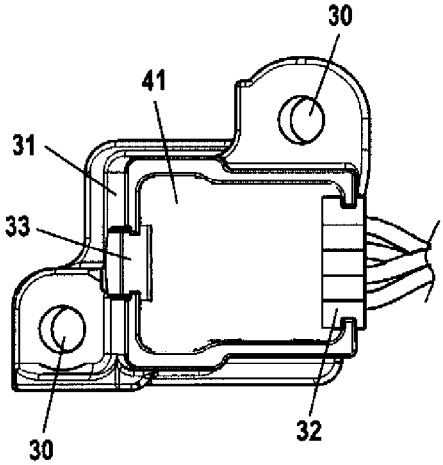
FIG. 10 is a side view in the direction of the arrow VI of FIG. 5 with potted sensors.

The configuration of the sensor component 13 is shown in detail in FIGS. 8 and 9. As FIGS. 8 and 9 show, the connecting channel 25 has a first channel section 42 which is configured approximately cylindrically. The first channel section 42 ends at a membrane 37 of the pressure sensor 27. The pressure sensor 27 closes the connecting channel 25. The temperature sensor 26 is arranged at a distance a ahead of the pressure sensor 27. The temperature sensor 26 has a temperature probe 38 which is electrically connected to the board 28 via a lead 39. The temperature probe 38 and a segment of the lead 39 are surrounded by a finger-shaped protective sleeve 40 which projects into the connecting channel 25. The distance (a) between the temperature sensor 26 and the pressure sensor 27 advantageously is several millimeters. The temperature sensor 27 projects into the connecting channel 25 by more than half the diameter of the connecting channel 25 and is flowed over by crankcase gas from all sides. The second section 43 of the connecting channel 25, which extends from the first section 42, is configured such that it widens in a funnel-like manner toward the crankcase interior 20. Thus, the formation of a constant pressure wave in the connecting channel 25 is prevented and the gas exchange to the pressure sensor 27 and to the temperature sensor 26 is assisted. As shown, the temperature sensor 26 is configured in an approximately rod-shaped manner and projects exclusively into the connecting channel 25 and, in particular, into the first section 42. Any projecting into the crankcase interior 20 is not provided.

As FIG. 8 shows, the base 35 of the connecting channel 25 in the first section 42 is inclined by an angle β to line 36. Angle β can be several degrees. The very small inclination angle is sufficient to allow dirt such as oil or the like to flow out of the second section 43. In the second section 43, the base 35 is inclined by a clearly larger angle α thereby ensuring good and fast flowing off of dirt or oil.

As FIGS. 8 and 9 show, the insert module 33 of the sensor housing 31 closes the sensor housing 31 adjacent to the board 28 over approximately one third of the width of the sensor housing 31. The entire sensor housing 31 is potted, that is, with the potting compound 41 shown in FIG. 10. Thus, all components are securely held in the sensor housing 31.

It is understood that the foregoing description is that of the preferred embodiments of the invention and that various changes and modifications may be made thereto without departing from the spirit and scope of the invention as defined in the appended claims.

What is claimed is:

1. A hand-guided work apparatus comprising:

a combustion engine having a crankcase defining a crankcase interior;

a crankshaft rotatably mounted about a rotational axis in said crankcase;

a pressure sensor and a temperature sensor;

a sensor housing common to both of said sensors;

said temperature sensor and said pressure sensor being arranged in said sensor housing;

said work apparatus being configured to have a set-down position wherein said work apparatus is placeable on a horizontal rest surface;

said pressure sensor and said temperature sensor being beneath a plane containing said rotational axis and said plane being parallel to said rest surface when said work apparatus is in said set-down position;

said sensor housing defining a connecting channel for causing said pressure sensor to communicate with said crankcase interior;

said connecting channel having a base which slopes down toward said crankcase interior when said work apparatus is in said set-down position on said rest surface;

a board held in said sensor housing; and, said pressure sensor and said temperature sensor both being arranged on said board;

wherein said pressure sensor, said temperature sensor and said board are potted in said sensor housing.

2. A hand-guided work apparatus comprising:

a combustion engine having a crankcase defining a crankcase interior;

a crankshaft rotatably mounted about a rotational axis in said crankcase;

a pressure sensor and a temperature sensor;

a sensor housing common to both of said sensors;

said temperature sensor and said pressure sensor being arranged in said sensor housing;

said work apparatus being configured to have a set-down position wherein said work apparatus is placeable on a horizontal rest surface;

said pressure sensor and said temperature sensor being beneath a plane containing said rotational axis and said plane being parallel to said rest surface when said work apparatus is in said set-down position;

said sensor housing defining a connecting channel for causing said pressure sensor to communicate with said crankcase interior; and, said connecting channel having a base which slopes down toward said crankcase interior when said work apparatus is in said set-down position on said rest surface;

wherein said crankcase has a receptacle; said sensor housing has a connecting stub; said connecting channel extends through said connecting stub; and, said connecting stub is inserted into said receptacle; and, wherein said connecting stub defines a longitudinal center axis which is inclined upwards toward said crankcase interior when said work apparatus is in said set-down position.

3. The work apparatus of claim 2, wherein said connecting channel at least partially widens in a funnel-like manner toward said crankcase interior.

4. The work apparatus of claim 2, wherein said temperature sensor is arranged in said connecting channel so as not to project into said crankcase interior.

5. The work apparatus of claim 4, wherein said temperature sensor is approximately rod shaped and projects unobstructed into said connecting channel.

6. The work apparatus of claim 2, wherein said connecting channel has an end; said temperature sensor is arranged at said end of said connecting channel; and, said temperature sensor is arranged ahead of said pressure sensor.

7. The work apparatus of claim 6, wherein said connecting channel has a first cylindrical section and a second funnel-shaped section; said first section extends from said pressure sensor; and, said temperature sensor is arranged in said first section.

8. The work apparatus of claim 2, wherein said sensor housing is sealed with respect to said crankcase in the radial direction of said connecting stub.

9. The work apparatus of claim 8, wherein said connecting stub has an outer periphery; said work apparatus further comprising: a seal arranged on said outer periphery of said connecting stub; and, said seal seals said sensor housing with respect to said crankcase.

10. The work apparatus of claim 2, wherein said connecting stub has a front edge facing said crankcase interior; and, said front edge has course adapted to the rounding of said crankcase interior.

11. The work apparatus of claim 2, further comprising a securing element configured to hold said sensor housing on said crankcase in the axial direction.

12. The work apparatus of claim 2 further comprising:

a board held in said sensor housing; and, said pressure sensor and said temperature sensor both being arranged on said board.

* * * * *